US005285140A

United States Patent [19]

Schoroth

[11] Patent Number: 5,285,140

[45] Date of Patent: Feb. 8, 1994

[54] GAS FRICTION PUMP

[75] Inventor: Anno Schoroth, Königswinter, Fed. Rep. of Germany

[73] Assignee: Leybold Aktiengesellschaft, Hanau, Fed. Rep. of Germany

[21] Appl. No.: 620,361

[22] Filed: Nov. 29, 1990

[30] Foreign Application Priority Data

Dec. 27, 1989 [DE] Fed. Rep. of Germany ..... 8915199

[51] Int. Cl.[5] ..... G01R 19/00

[52] U.S. Cl. ..... 318/490; 361/22

[58] Field of Search ..... 318/254, 138, 139, 439, 318/55, 59, 66, 798, 800, 801, 453, 490; 361/86, 87, 23, 31, 93, 22

[56] References Cited

U.S. PATENT DOCUMENTS

| | | | |
|---|---|---|---|
| 3,946,574 | 3/1976 | Portera | 361/31 X |
| 4,090,114 | 5/1978 | Thompson | 318/139 |
| 4,099,704 | 7/1978 | Okumura et al. | 318/469 X |
| 4,268,884 | 5/1981 | Ford, Jr. et al. | 361/22 X |
| 4,494,180 | 1/1985 | Streater | 318/801 X |
| 4,602,484 | 7/1986 | Bendikson | 361/22 X |
| 4,709,292 | 11/1987 | Kuriyama et al. | 361/22 |
| 4,806,839 | 2/1989 | Nagato et al. | 361/22 X |
| 4,809,122 | 2/1989 | Fitzner | 361/86 |
| 5,019,757 | 5/1991 | Beifus | 318/254 |

OTHER PUBLICATIONS

"Theorie Und Praxir Der Vakuumtechnik", Wutz-/Adam/Walcher pp. 203-223.

*Primary Examiner*—Jonathan Wysocki
*Attorney, Agent, or Firm*—Felfe & Lynch

[57] ABSTRACT

A gas friction pump with rotor and stator, a motor for driving the rotor, and a circuit serving as a power supply to the motor, the circuit having electronic components for representing the current drawn by the motor.

2 Claims, 1 Drawing Sheet

GAS FRICTION PUMP

BACKGROUND OF THE INVENTION

The invention relates to a gas friction pump circuit with a gas friction pump with rotor and stator, with a motor for driving the rotor, and with a circuit serving as a power supply for the motor.

The gas friction pumps include molecular and turbomolecular pumps, whose operation is described in detail in the textbook by Wutz/Adam/Walcher, "Theorie und Praxis der Vacuumtechnik," pages 202 ff. They have rotating and stationary components, which are so configured and spaced apart that the pulses transferred by the components to the gas molecules between them have a preferred direction. Gas friction pumps are high-vacuum pumps that have no tolerable back pressure, and therefore backing pumps must be connected to their discharge.

To determine whether a specific pressure has been reached in a vessel connected to a vacuum pump, it is known to use vacuum gauges. Vacuum gauges of this kind are relatively expensive. They are complicated to use, especially when all that is to be determined is whether or not a specific pressure limit has been reached. This is the case, for example, in the evacuation of hollow glass bodies for cathode ray tubes, which are sealed by fusion after a certain pressure is reached.

The present invention is addressed to the problem of creating a gas friction pump circuit of the kind described above, which in a simple manner will make it possible to know that a pressure limit has been reached by the pump.

This problem is solved in accordance with the invention by providing the circuit serving to supply power to the motor with electronic components by which the current drain of the motor can be recorded.

In the present invention use is made of the known fact that the current consumed by the motor of the gas friction pump is dependent on the pressure produced by the pump, and that this pressure is an indication of the pressure reached in the connected hollow body. In the study of this relationship I obtained the knowledge that there is a pressure range in which the friction power produced by the gas friction diminishes relatively rapidly with the reduction of pressure, while the friction power caused by the bearing friction varies but little. In this pressure range the gas friction becomes negligible, so that below the stated pressure range only the bearing friction remains to be overcome. I have found that these circumstances, in friction pumps of the same type, i.e., with a specific pump output, differ but little, so that it is possible to know, on the basis of the power drain, whether or not a specific pressure has been reached. It is therefore possible within the relatively great dependency of $dI/dp$, to establish a threshold which permits a repeatable pressure-related "go/no go" decision, where I represents current (in mA) and p represents pressure (in mbar). The means that are necessary for the establishment of such a switching threshold are substantially simpler than a complete vacuum gauge.

A desirable further development consists in indicating the current drain by a display. Such a display supplies relatively rough but reliable information on the pressure conditions that have been reached.

SUMMARY OF THE INVENTION

In accordance with the invention, a gas friction pump comprises a gas friction pump with rotor and stator, a motor for driving the rotor, and a circuit serving as a power supply to the motor, the circuit having electronic components for representing the current drawn by the motor.

For a better understanding of the invention, together with other and further objects thereof, reference is made to the following description, taken in connection with the accompanying drawings, and its scope will be pointed out in the appended claims.

BRIEF DESCRIPTION OF THE DRAWINGS

Referring now to the drawings.

DESCRIPTION OF PREFERRED EMBODIMENT

Figure 1:
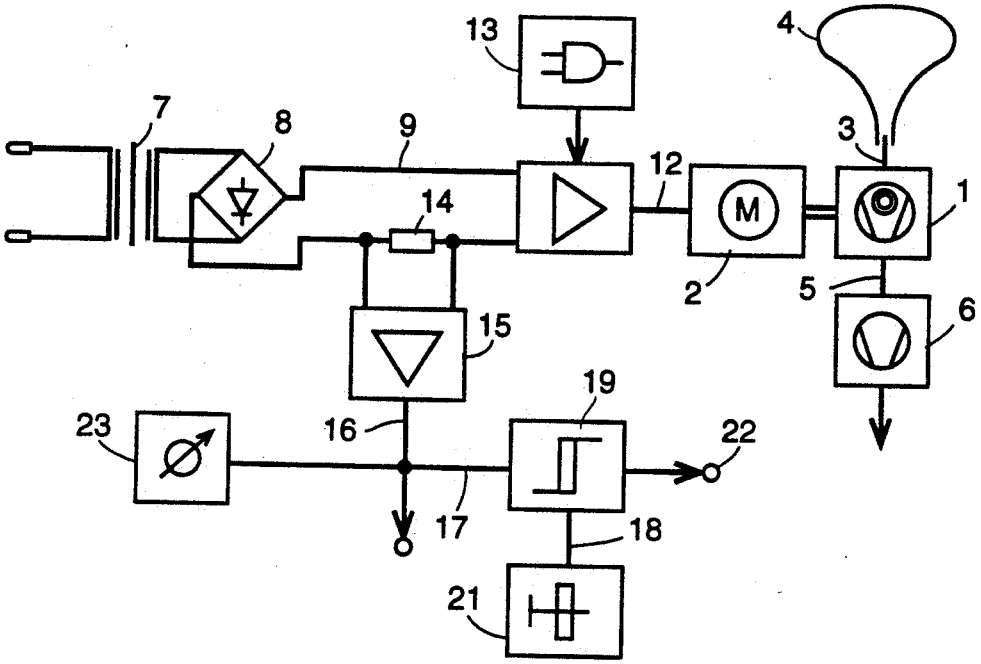
FIG. 1 shows a turbomolecular vacuum pump with motor and power supply circuit.

FIG. 1 shows a turbomolecular vacuum pump 1 with its motor 2. The interior of the hollow glass body 4 of a cathode-ray tube is connected to the suction 3 of the pump 1. This hollow glass body is to be evacuated down to a specific pressure. The backing pump 6 is connected to the discharge 5 of the pump 1.

The power transformer 7 and the rectifier circuit 8 are provided for running the motor 2. Consequently, on the motor side there is the intermediate circuit 9 with the output stage 11. The output 12 of the output stage 11 is directly connected to the motor 2. Unit 13 is a logic unit which acts on the output stage 11 by which the desired operations can be controlled.

Figure 2:
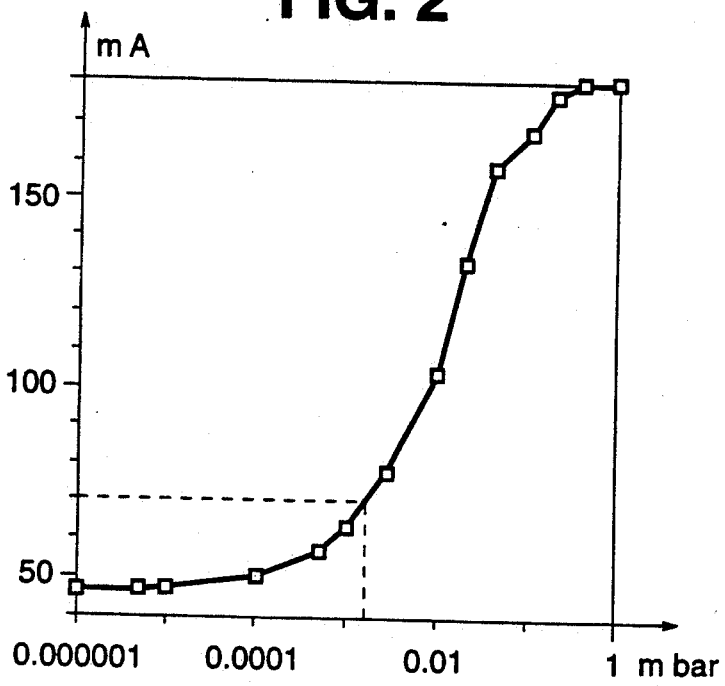
FIG. 2 shows the relationship between pressure and the current taken by the motor.

As FIG. 2 shows, the current flowing in the intermediate circuit 9 is dependent on pressure, especially in the low-pressure range. In the case of the turbomolecular vacuum pump here involved, a 50-liter pump, the gas friction content below $10^{-4}$ is at the vanishing point. All that remains to be overcome by the motor is the bearing friction. Above $10^{-4}$ mbar up to about $10^{-1}$ mbar, the relationship of the current to the pressure on account of the incipient gas friction is relatively high. Consequently the current drain can be evaluated electrically. At approximately $10^{-3}$ mbar, therefore, a cut-off threshold can be established.

The load 14 is provided so as to be able to measure or record the current in the intermediate circuit 9. The inputs of the amplifier 15 are connected ahead of and behind the load 14 to the circuit 9, so that the voltage drop across the load 14 can be used for measuring the current in the intermediate circuit 9. An analog signal can be picked up directly at the output 16 of the amplifier 15. This analog signal provides an index of the pressure in the hollow glass body 4.

To produce an electrical signal when a certain pressure limit is reached, it is desirable to connect the output 16 of amplifier 15 with one of the inputs 17 and 18 of a comparator 19. The circuit 21 is connected to the second input of the comparator 19 and permits a threshold to be set. When the threshold is reached the comparator delivers an electrical signal to its output 22 or to a relay by which subsequent operations in the manufacturing process, for example, can be started.

It is also possible to represent the current measurement at the output 16 by means of a display 23. Such a display provides reliable indications of the pressures reached.

In an embodiment configured in accordance with FIGS. 1 and 2, the hollow glass body 4 is connected to the input 3 of the turbomolecular pump 1. Then follows the evacuation of the hollow glass body. If the hollow glass body 4 is free of defects the current drain (current in the intermediate circuit 9) diminishes in accordance with FIG. 2. If the current falls below about 70 Ma, the assurance is provided that a pressure of about $10^{-3}$ mbar has been reached. If the threshold setting circuit 21 is set for this level, the signal delivered by the comparator 19 can initiate, for example, the procedure of fusing the hollow glass body shut.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Gas friction pump circuit for the evacuation of a receptacle (4) to a specific pressure comprising:

a gas friction pump (1) with rotor and stator;

a motor (2) for driving the rotor, and a circuit serving as a power supply for the motor, including a mains portion (7), (8), as well as an output stage (11) that is in connection with the motor and which together form an intermediate circuit (9), for the production of an electrical signal upon a drop below a specific pressure, the intermediate circuit including a current sensor (14), the power supply circuit including an amplifier (15) having an output for supplying output analog signals and having inputs connected through the current sensor to the intermediate circuit, the power supply circuit also including a comparator (19), having a first input connected to the amplifier output and having a second input, the power supply circuit also including a stage (21) serving for the setting of a threshold value connected to a second input of the comparator, the comparator (19) having an output which supplies an electrical signal whenever the current in the intermediate circuit (9) falls below a value corresponding to the set threshold value.

2. A gas friction pump circuit according to claim 1, which includes a display means (23) connected to the output of the amplifier to indicate the current measurement.

* * * * *